US005992830A

United States Patent [19]

Daubs et al.

[11] Patent Number: 5,992,830

[45] Date of Patent: Nov. 30, 1999

[54] HIGH PRESSURE QUARTZ GLASS BUBBLER

[75] Inventors: Maurice E. Daubs, Seward, Ill.; James H. Murphy, Jr., Washington, Pa.

[73] Assignee: Olin Corporation, Norwalk, Conn.

[21] Appl. No.: 08/990,330

[22] Filed: Dec. 15, 1997

[51] Int. Cl.[6] ..... B01F 3/04; F17C 3/00

[52] U.S. Cl. ..... 261/121.1; 206/524.6; 215/371; 220/608

[58] Field of Search ..... 261/61, 64.1, 74, 261/121.1, 124, 126; 206/524.6; 215/45, 259, 371, 378; 220/581, 601, 602, 608, 662, 917

[56] References Cited

U.S. PATENT DOCUMENTS

| | | | |
|---|---|---|---|
| 2,912,018 | 11/1959 | Leech | 261/121.1 |
| 3,889,835 | 6/1975 | Avant et al. | 220/581 |
| 4,134,514 | 1/1979 | Schumacher et al. . | |
| 4,140,735 | 2/1979 | Schumacher . | |
| 4,487,619 | 12/1984 | Jones . | |
| 4,526,730 | 7/1985 | Cochran et al. | 261/121.1 |
| 4,612,772 | 9/1986 | Jones . | |
| 4,851,821 | 7/1989 | Howard et al. . | |
| 4,886,178 | 12/1989 | Graf . | |
| 4,904,419 | 2/1990 | Reynolds | 261/64.1 |
| 4,915,880 | 4/1990 | Jenkins | 261/124 |
| 4,979,545 | 12/1990 | Fair . | |

FOREIGN PATENT DOCUMENTS

| | | | |
|---|---|---|---|
| 30068 | 9/1907 | Austria | 215/371 |

*Primary Examiner*—C. Scott Bushey
*Attorney, Agent, or Firm*—Ohlandt, Greeley Ruggerio & Perle

[57] ABSTRACT

A bubbler ampoule and bubbler assembly for containing highly corrosive chemicals is configured so as to provide enhanced strength which allows safe transport and usage of high vapor pressure chemicals. The enhanced assembly strength is provided by controlling the ratio of the bottom wall thickness to the side wall thickness of the ampoule; and by providing properly radiused corners on the ampoule.

8 Claims, 2 Drawing Sheets

HIGH PRESSURE QUARTZ GLASS BUBBLER

BACKGROUND OF THE INVENTION

1. Field of the Invention

This invention relates to a bubbler ampoule and assembly for containment and shipping of toxic and corrosive liquid chemicals; and more particularly to a bubbler ampoule and assembly for containment of ultra high purity liquid chemicals that can develop relatively high vapor pressures.

2. Brief Description of the Art

Many manufacturing processes utilize high-purity liquid chemicals which are entrained in a carrier gas for such procedures as semiconductor water doping, vapor deposition, water surface etching and cleaning, and the like. These high-purity liquid chemicals are shipped in and dispensed from high purity containers commonly known as "bubblers", due to the nature of the dispensing process. The bubbler assemblies are commonly formed from high purity quartz glass, glass, silicon, and non-reactive polymers, among other suitable materials. U.S. Pat. No. 4,140,735 Schumacher; U.S. Pat. No. 4,851,821 Howard et al.; and U.S. Pat. No. 4,886,178 Graf, all describe typical liquid chemical bubbler assemblies and systems that use liquid chemical bubbler assemblies.

Liquid chemical bubbler assemblies are used in the following manner in the production of semiconductor wafers or other components. The liquid chemical is disposed in a sealed container, i.e., the bubbler assembly, which includes an ampoule and inlet and outlet valves. The ampoule is provided with an inlet neck that is connected to a hollow dip tube portion for admitting a carrier gas to the ampoule, which dip tube portion extends below the surface of the chemical in the ampoule. The ampoule also includes an outlet neck from which a gas stream that has been saturated with the liquid chemical is fed to the wafer processing station. The carrier gas stream is passed through the inlet neck and enters the liquid chemical below the surface of the chemical, where it bubbles its way to the top of the liquid chemical. The bubbling action creates an upper area in the bubbler assembly that is saturated with the chemical entrained in the carrier gas. The saturated solution is then drawn out of the bubbler assembly through the outlet neck and fed into a high temperature processing zone, or the like, where the chemical is exposed to the semiconductor wafers or other components to be treated. The inlet and outlet necks of the ampoule are fitted with valves that are manipulated to control the release of the chemical from the ampoule. The ampoule and the valves combine to form the bubbler assembly.

The particular liquid chemicals which are used in the aforesaid systems include, among others: 1,1,1-trichloroethane; 1,2 dichloroethylene; phosphorus oxychloride; boron tribromide; and the like. Some of these chemicals develop high vapor pressures while in use, and high-pressure vessels are needed for containment. This is particularly the case with the more corrosive chemicals used for etching and cleaning semiconductor wafers. One problem associated with the dispensing of the aforesaid chemicals relates to the strength of the bubbler assemblies which house the chemicals, and their ability to withstand relatively high degrees of pressurization without breaking. This is a particular problem when the ampoules must be formed from high purity quartz glass due to the nature of the chemicals they will be containing. Typical flat-bottomed ampoules which are made from high purity quartz glass are capable of being pressurized to pressures in the range of about fifteen psi to about twenty psi before bursting. It would be highly desirable to have a liquid chemical bubbler ampoule and assembly which could withstand higher pressures without bursting.

BRIEF SUMMARY OF THE INVENTION

This invention relates to a liquid chemical bubbler ampoule and assembly which is configured so as to be able to withstand higher internal pressures without bursting. Bubbler ampoules and assemblies which are formed in accordance with this invention can thus be safely utilized as high vapor pressure chemical dispensing containers. Bubbler ampoules formed in accordance with this invention include an inlet neck and an outlet neck, and a chemical temperature-monitoring well. The walls of the ampoule are configured so as to enhance the strength of the assembly so that it can sustain the necessary higher internal pressures generated by the chemicals contained therein. In order to enhance the strength of the walls in the ampoules, the thickness of the ampoule wall is selectively varied, and the curvature of the corners and of the bottom surface of the ampoule wall is selectively controlled. In particular, the bottom wall of the ampoule is made thicker than the side walls, and the radius of curvature of the upper and lower corners of the ampoule is enlarged so that the transition from the side wall to the top and bottom walls of the ampoule is more gradual than in the prior art. Additionally, the bottom wall of the ampoule may also be provided with an inwardly curved annular component which serves to strengthen the ampoule.

It is therefore an object of this invention to provide an improved liquid chemical bubbler ampoule and assembly which is structurally modified so as to provide increased wall strength.

It is a further object of this invention to provide a bubbler ampoule and assembly of the character described which is able to contain liquid chemicals at higher pressures so as to maintain the integrity of chemicals which have high vapor pressures.

It is another object of this invention to provide a bubbler ampoule and assembly of the character described which is configured so as to provide a more controllable carrier gas flow through the liquid chemical.

These and other objects and advantages of the invention will become more readily apparent from the following detailed description of a preferred embodiment of the invention when taken in conjunction with the accompanying drawings, in which:

DETAILED DESCRIPTION FOR CARRYING OUT THE INVENTION

Figure 1:
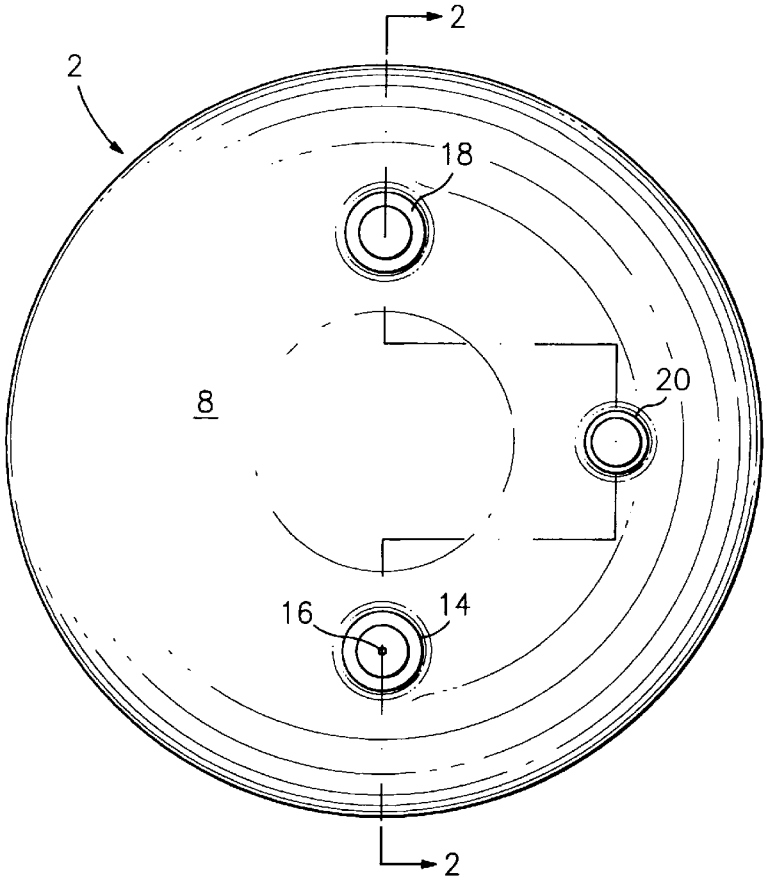
FIG. 1 is a top plan view of a liquid chemical-saturated gas-producing bubbler ampoule which is formed in accordance with this invention.
Figure 2:
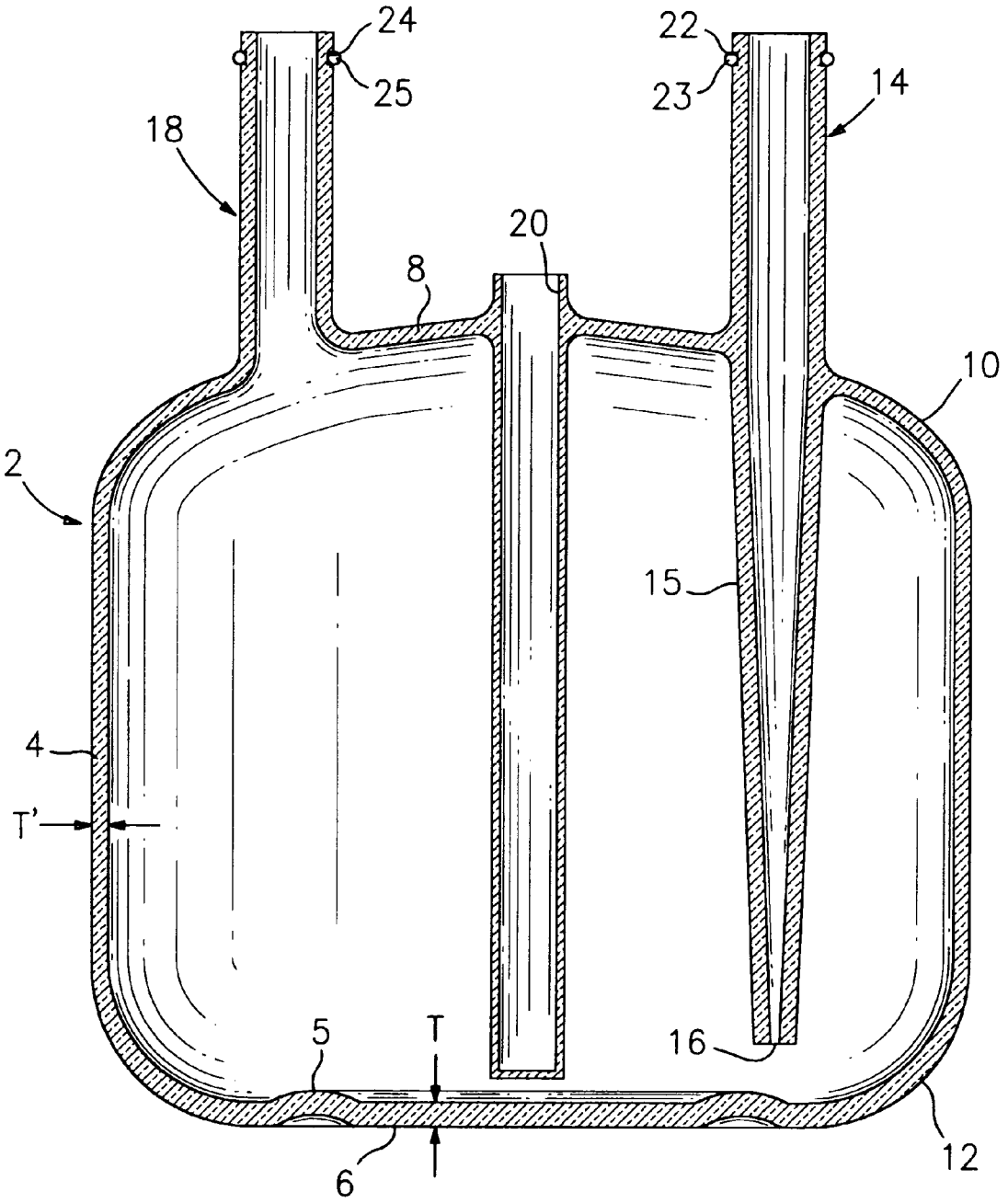
FIG. 2 is a sectional view of the ampoule taken along line 2—2 of FIG. 1.

Referring now to the drawings, there is shown in FIGS. 1 and 2, an embodiment of an improved ampoule, which is denoted generally by the numeral 2, and which is formed in accordance with this invention. The ampoule 2 has a circular side wall 4, a bottom wall 6, and a top wall 8. The side wall 4 and the top wall 8 are interconnected by a curvilinear corner wall 10; and the side wall 4 and the bottom wall 6 are likewise interconnected by a curvilinear corner wall 12. The bottom wall 6 is essentially flat, and the top wall 8 is essentially curved upwardly and outwardly. The ampoule 2 includes an integral gas inlet neck 14 that connects with a gas inlet dip tube 15 which extends downwardly into the ampoule 2, and tapers to a terminal nozzle opening 16 through which the carrier gas stream is bubbled into the liquid chemical contained in the ampoule 2. The opening 16 is sized so as to accurately control the amount of carrier gas released into the liquid chemical, and the size of the carrier gas bubbles. The ampoule 2 also includes an integral outlet neck 18 through which the chemically-saturated carrier gas stream is expelled from the ampoule 2. The necks 14 and 18 are provided with sealing and locking ring grooves 22 and 24 respectively, in which sealing and locking rings 23 and 25 respectively, are mounted. The ampoule 2 also is provided with a close-ended temperature monitoring well 20 in which a thermal probe (not shown) is placed so as to allow monitoring of the temperature of the contents of the ampoule 2. In order to strengthen the ampoule 2 against bursting, its walls 4 and 6, and corners 10 and 12 are specially configured. In an ordinary bubbler ampoule, the walls of the ampoule are all essentially the same thickness and the corners are rounded with a relatively small radius of curvature, i.e., about ten percent of the diameter of the ampoule base.

The bubbler ampoule of this invention is sized and configured so that the upper and lower corner radii of the ampoule have a radius of curvature which is about thirty percent of the diameter or width of the ampoule. The ampoule will typically have a diameter of up to about one hundred forty mm. The inclusion of the restricted annular radiused rib 5 in the bottom wall 6 allows the lower corner to be maintained at the thirty percent radius-to-ampoule diameter ratio, while providing a maximum base wall area so as to ensure proper support for the ampoule 2. The minimum thickness T of the bottom wall 6 is at least about one and one half times the minimum thickness of the side wall T', which is typically about two mm.

Figure 3:
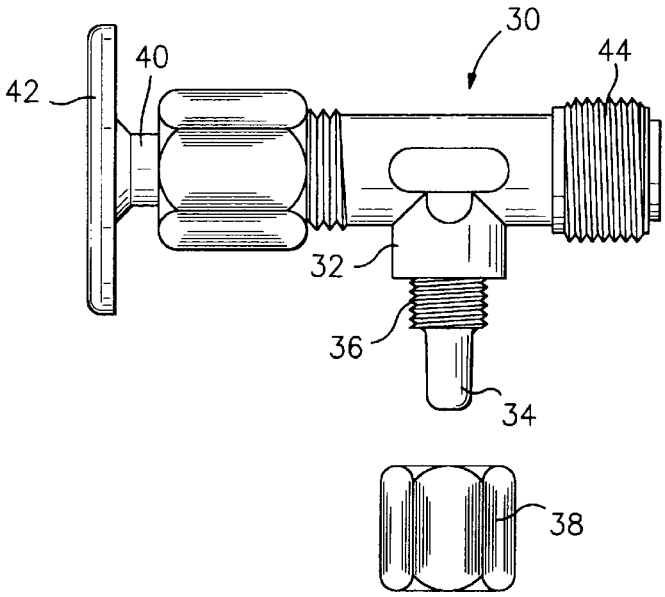
FIG. 3 is an exploded side elevational view of an inlet/outlet valve assembly which is used in conjunction with the ampoule of FIG. 1.

Referring now to FIG. 3, an embodiment of a bubbler assembly-sealing valve, which is denoted generally by the numeral 30, is shown. It will be understood that the valve such as illustrated in FIG. 3 is mounted on both of the necks 14 and 18 to complete the bubbler assembly. The valve 30 will typically be formed from PTFE, or some other corrosion-resistant plastic material. The valve 30 is a T-shaped valve and includes a nipple 32 which extends into the neck 14 or 18 on the ampoule 2. The nipple 32 includes a terminal portion 34 which telescopes into the ampoule neck 14 or 18, and an externally threaded portion 36 which abuts the end wall of the ampoule neck 14 or 18. An internally threaded lock nut 38 is fitted onto the ampoule neck 14 or 18, and is operable to be screwed onto the portion 36 of the valve 30, and is also operable to engage the locking-sealing rings 23 or 25 which are mounted in the grooves 22 or 24 on the ampoule necks 14 and 18. In this fashion, the valve 30 can be tightened down by the nut 38 into sealing engagement with the ampoule necks 14 or 18. The valve 30 includes a conventional internal valve stem 40 which can be manipulated by a handle 42 to open or close the valve 30 to flow of carrier gas into the ampoule 2; and to open or close the valve 30 to flow of chemical-saturated carrier gas out of the ampoule 2. The valve 30 includes an externally threaded end 44 which is connected to a carrier gas inlet line when mounted on neck 14, and to a carrier gas-chemical mixture when mounted on neck 18.

The ampoule 2 is filled in the following manner. To commence the filling operation, the ampoule 2 is filled with an inert nitrogen gas by connecting a nitrogen gas line to the ampoule neck 14 via the valve 30 mounted on the neck 14. The valve 30 on the outlet neck 18 is removed from the neck 18, and the chemical is added to the ampoule 2 through the neck 18. As the chemical fills the ampoule 2, the nitrogen gas is driven from the ampoule 2 through the neck 18. The flow of nitrogen gas out of the ampoule 2 through the neck 18 prevents ambient air and other ambient contaminants from entering the ampoule 2 during the filling process. Once the ampoule 2 is filled with the appropriate amount of chemical, the valve 30 on the neck 14 is closed, the nitrogen gas line disconnected therefrom, and the valve 30 is re-connected to the neck 18. The filled ampoule is then ready for shipment.

It will be appreciated that the bubbler ampoule and assembly of this invention can be operated at higher vapor pressures without a significant danger of bursting. In certain end-use systems, automated opening and closing of the valves on the ampoule can cause rapid internal pressure changes that exceed present manufacturer ampoule strength specifications, but which can be accommodated by the assembly of this invention. The enhanced ampoule strength achieved by the configuration of this invention also enhances shipping durability and operational safety of the filled ampoules with respect to the ultimate user.

Since many changes and variations of the disclosed embodiment of the invention may be made without departing from the inventive concept, it is not intended to limit the invention otherwise than as required by the appended claims.

What is claimed:

1. A glass ampoule for containing a high purity high vapor pressure liquid chemical, said ampoule having a side wall defining a width of said ampoule, a top wall and a bottom wall, said top and said bottom wall being connected to said side wall by radiused upper and lower corners respectively, said upper and lower corners having a radius of curvature which is about thirty percent of the width of said ampoule, wherein said bottom wall is formed with an inwardly curved annular rib which is located at an end of said lower corners, and wherein said bottom wall is essentially flat except for said annular ribs.

2. The ampoule of claim 1 wherein said annular rib merges with said lower corner.

3. The ampoule of claim 1 wherein said top wall is essentially curvilinear throughout its entire extent.

4. The ampoule of claim 1 wherein the glass is quartz glass.

5. A glass ampoule for containing a high purity high vapor pressure liquid chemical, said ampoule having a side wall, a top wall and a bottom wall, said top and said bottom wall being connected to said side wall by radiused upper and lower corners respectively, said bottom wall having a minimum thickness which is at least one and one-half times the thickness of each side wall, wherein said bottom wall is formed with an inwardly curved annular rib which is located at an end of said lower corners, and wherein said bottom wall is essentially flat except for said annular ribs.

6. The ampoule of claim 5 wherein said side wall has a thickness of about two mm.

7. The ampoule of claim 6 wherein said ampoule is circular in plan view and wherein said side wall is connected to said top and bottom walls by upper and lower curvilinear corners which have a radius of curvature which is about thirty percent of the outer diameter of said side wall.

8. The ampoule of claim 5 wherein said glass is quartz glass.

* * * * *